United States Patent [19]

Scheying

[11] 4,367,706

[45] Jan. 11, 1983

[54] FUEL INJECTION PUMP FOR AIR-COMPRESSING FUEL INJECTED INTERNAL COMBUSTION ENGINES

[75] Inventor: Heinz Scheying, Stuttgart, Fed. Rep. of Germany

[73] Assignee: Daimler-Benz A.G., Stuttgart, Fed. Rep. of Germany

[21] Appl. No.: 69,262

[22] Filed: Aug. 24, 1979

[30] Foreign Application Priority Data

Aug. 24, 1978 [DE] Fed. Rep. of Germany ..... 2836961

[51] Int. Cl.[3] ..... F02M 45/06

[52] U.S. Cl. ..... 123/300; 123/503

[58] Field of Search ..... 123/500, 501, 503, 506, 123/299, 300; 417/493, 494, 495

[56] References Cited

U.S. PATENT DOCUMENTS

| | | | |
|---|---|---|---|
| 1,993,759 | 3/1935 | Stockmeyer | 417/494 |
| 2,173,813 | 9/1939 | Bischof | 123/300 |
| 2,713,310 | 7/1955 | Muraszew | 123/506 |
| 3,387,597 | 6/1968 | Wirsching | 123/506 |
| 3,394,891 | 7/1968 | Voit | 123/299 |
| 3,435,811 | 4/1969 | Guertler | 123/506 |

*Primary Examiner*—Craig R. Feinberg
*Assistant Examiner*—Carl Stuart Miller
*Attorney, Agent, or Firm*—Paul M. Craig, Jr.

[57] ABSTRACT

A fuel injection pump for an air-compressing fuel injected internal combustion engine with a pump piston arranged in a pump cylinder and controlling a fuel control bore in the pump working chamber and with a control element in constant connection with the pump piston for the purposes of fuel control. The control element is constructed so that it constantly connects the pump working chamber to an intermediate chamber located above the control element and serving as a reservoir. The control element connects the pump working chamber and the pump pressure chamber by way of a bore arrangement only during a piston stroke. An arrangement is provided by which the communication between the pump working chamber and pump pressure chamber is temporarily interrupted during the piston stroke in such a way that, prior to the interruption, a variable preliminary injection quantity is conveyed and, after the interruption, a principal injection quantity is fed.

9 Claims, 2 Drawing Figures

FUEL INJECTION PUMP FOR AIR-COMPRESSING FUEL INJECTED INTERNAL COMBUSTION ENGINES

The present invention relates to an injection pump and, more particularly, to a fuel injection pump for an air-compressing fuel injected internal combustion engine which injection pump includes a pump piston arranged in each pump cylinder for controlling a fuel control bore in a pump working chamber and control element in constant connection with the pump piston for the purposes of fuel control, which control element is constructed so that it constantly communicates the pump working chamber to an intermediate chamber, serving as a reservoir, located above the control element and also communicates the pump working chamber with a pump pressure chamber by way of a bore arrangement disposed in the control cylinder only during a stroke of the pump piston.

An injection pump of the aforementioned type is proposed in, for example, Offenlegungsschrift 26 47 788 wherein the control element is provided with a beveled portion which has a slight slope toward an outer periphery of the control element. Such a construction is to have the effect that initially a throttled amount of fuel is injected and, thereafter, under high pressure, an unthrottled fuel quantity is injected so as to provide a smooth operation of the internal combustion engine even when the engine is subjected to frequent load changes.

The aim underlying the present invention essentially resides in providing a fuel injection pump for an air-compressing fuel injected internal combustion engine by which a fuel injection step is separated into a preliminary injection and a principal injection with the preliminary injection being controlled in dependence upon a load of the internal combustion engine.

In accordance with the present invention, means are provided for temporarily interrupting the communication between the pump working chamber and the pump pressure chamber for a predetermined time during a stroke of the pump piston in such a manner that, prior to interruption of the communication, a variable preliminary injection quantity and, after this a principal injection quantity, are to be conveyed to the fuel injection nozzles of the internal combustion engine.

By providing a separated or divided injection or preliminary injection and principal injection, the pressure rise in the control cylinder of the pump element of the injection pump during the conveying step or stroke of the pump piston is kept at a low level, thereby resulting in a smooth and quiet operation of the internal combustion engine.

Since internal combustion engines do not require an identical preliminary injection quantity in all load conditions, in accordance with the present invention, the preliminary injection quantity is controllable by a control edge arranged at the top of the pump piston.

In accordance with advantageous features of the present invention, the control element can be constituted by a control slide guided so as to be longitudinally displaceable within a control cylinder with the control slide being provided with a bore arrangement which includes a connecting bore means for placing the pump working chamber in communication with the intermediate chamber and two additional bore means branching off from the connecting bore means with one of the additional bore means being intended as a preliminary injection bore and the second of the additional bore means being intended as a principal injection bore.

With an injection pump having a bore arrangement located in the control cylinder and leading to the pump pressure chamber, in accordance with further features of the present invention, this bore arrangement may first connect the pump pressure chamber with the pump working chamber by way of the first of the additional bore means of the bore arrangement in the control slide and then connect these chambers by way of the second additional bore means.

To provide for a space-saving construction as well as a construction which reduces manufacturing expenses, in accordance with the present invention, the control element for the fuel control may be fashioned as an integral part of the pump piston.

According to the present invention, in an injection pump with a bore arrangement leading to the pump pressure chamber, the control element, provided with control edges, may be arranged in a half of the pump piston which lies oppositely to the half of the pump piston provided with top-positioned and bottom-positioned control edges. Moreover, the pump piston may be provided with a neck below the control element and with an annular chamber, serving as the pump working chamber, being formed between the neck and pump cylinder which annular chamber is adapted to place the pump working chamber in constant communication with the intermediate chamber above the pump piston by way of a passage in the control element, which passage may be formed by, for example, a groove.

In accordance with a still further feature of the present invention, the top-positioned control edge of the control element serves as the control edge for interrupting the fuel conveying step, i.e., the end of the preliminary injection, and the bottom-positioned control edge serves for reinstating the fuel conveying step, i.e., the beginning of the principal injection.

Accordingly, it is an object of the present invention to provide a fuel injection pump for air-compressing fuel injected internal combustion engines which avoids, by simple means, shortcomings and disadvantages encountered in the prior art.

Another object of the present invention resides in providing a fuel injection pump for air-compressing fuel injected internal combustion engines which divides the fuel injection step into a preliminary and principal injection.

Yet another object of the present invention resides in providing a fuel injection pump for air-compressing fuel injected internal combustion engines which enables the preliminary injection quantity to be varied for respective load conditions of the internal combustion engine.

A further object of the present invention resides in providing a fuel injection pump for air-compressing fuel injected internal combustion engines which insures smooth quiet operation of the internal combustion engine.

A still further object of the present invention resides in providing a fuel injection pump for an air-compressing fuel injected internal combustion engine which functions reliably under all operating or load conditions of the internal combustion engine.

Another object of the present invention resides in providing a fuel injection pump for an air-compressing fuel injected internal combustion engine which is simple in construction and therefore relatively inexpensive to manufacture.

These and other objects, features, and advantages of the present invention will become more apparent when taken in connection with the accompanying drawing which shows, for the purposes of illustration only, two embodiments in accordance with the present invention, and wherein.

Figure 1:
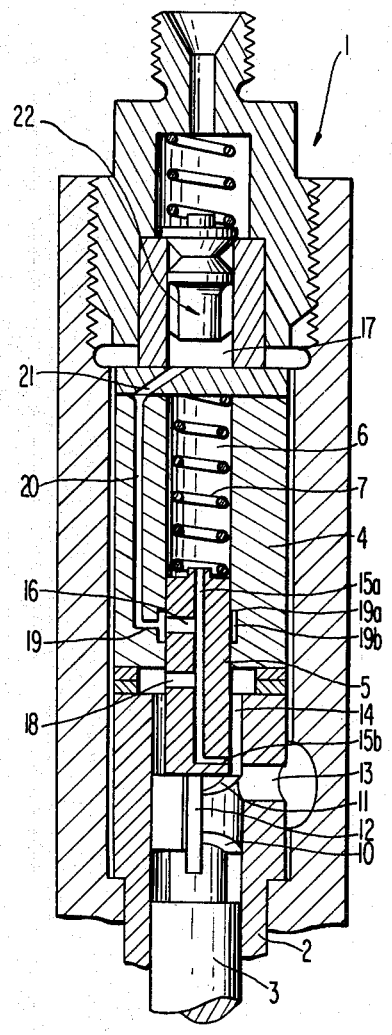
FIG. 1 is a longitudinal cross-sectional view of a pump element of a fuel injection pump having a pump piston and fuel control slide in accordance with a first embodiment of the present invention.

Referring now to the drawings wherein like reference numerals are used throughout the several views to designate like parts and, more particularly, to FIG. 1, according to this figure, a pump element 1 of a fuel injection pump for air-compressing fuel injected internal combustion engines includes a pump piston 3 longitudinally displaceably guided in a pump cylinder 2 and a control element 5 guided in a control cylinder 4 with the control element 5 being fashioned as a control slide. The control element 5, under the effect of a compression spring 7 arranged in an intermediate chamber 6, is in constant contact with the pump piston 3.

The pump piston 3, driven in a conventional manner by a cam of a drive shaft (not shown) is provided with a bottom-positioned control edge 10 and a top-positioned control edge 11. Th control edges 10, 11 are shaped or contoured in correspondence with desired quantities of fuel to be injected so as to control the injected fuel quantity. The control edges 10, 11 are in communication with a longitudinal groove 12.

The pump cylinder 2 is provided with a radial control bore 13 through which fuel to be injected passes. The fuel passes through the control bore 13 and into a working chamber 14 when the pump piston 3 is in a bottom dead center positon. The fuel passes from the working chamber 14 by way of bores 15*a*, 15*b*, and 16 of a bore arrangement in the control slide 5 to an intermediate chamber or reservoir 6 and, by way of inlet bores 19, 20, and 21 of a bore arrangement in the control cylinder 4, to a pump pressure chamber 17.

The bore 15*a* of the bore arrangement in the control slide 5 extends longitudinally of the control slide 5 and terminates in the intermediate chamber or reservoir 6 with the bore 15*b* branching off from the longitudinal bore 15*a* and extending transversely thereof. The bore 15*b* is in communication with an annular pump working chamber 14. The bore 16 is a transverse bore which branches off from the longitudinal bore 15*a* at a top portion of the control slide 5 with an additional transverse bore 18 being positioned at a bottom portion of the control slide 5. The transverse bore 18 is in communication with the pump working chamber 14. The top-positioned transverse bore 16 is in communication with the inlet bores 19, 20, and 21 of the bore arrangement in the control cylinder 4 as can be seen from the illustrated position of the control slide 5 in FIG. 1.

The inlet bore 21 leads into the pump pressure chamber 17 and fuel is conveyed by the pump pressure chamber 17 through a spring loaded pressure valve 22 and through a pressure or feed line (not shown) to an injection nozzle (not shown) of the internal combustion engine.

The mode of operation of the pump element 1 of FIG. 1 is as follows:

A feed pump (not shown) takes in fuel from a fuel tank or fuel supply (not shown) and forces the fuel, in the bottom dead center position of the pump piston 3, by way of the control bore 13 into the pump working chamber 14, into the intermediate chambers 6 and into the pump pressure chamber 17. During an upward stroke of the pump piston 3, the pump piston 3 seals the control bore 13. Preliminary injection begins and is interrupted only after the top-positioned transverse bore 16 has been moved beyond an upper edge 19*a* of a recess 19*b* associated with the inlet bore 19 whereby a feeding of the fuel is thus interrupted. During this time, the pressure in the pump working chamber 14 and intermediate chambers 6 rises until the bottom-positioned transverse bore 18 terminates the interruption phase. The principal amount of fuel is now released through the transverse bore 18 to the fuel injection nozzle. As sooon as the lower control edge 10 of the pump piston 3 has moved beyond the control bore 13, the end of the principal injection phase has been reached.

In addition to controlling the principal injection quantity, it is also possible to control the preliminary injection quantity by the control edge 11 located at the top of the pump piston 3 in dependence upon the load conditions of the internal combustion engine.

Figure 2:
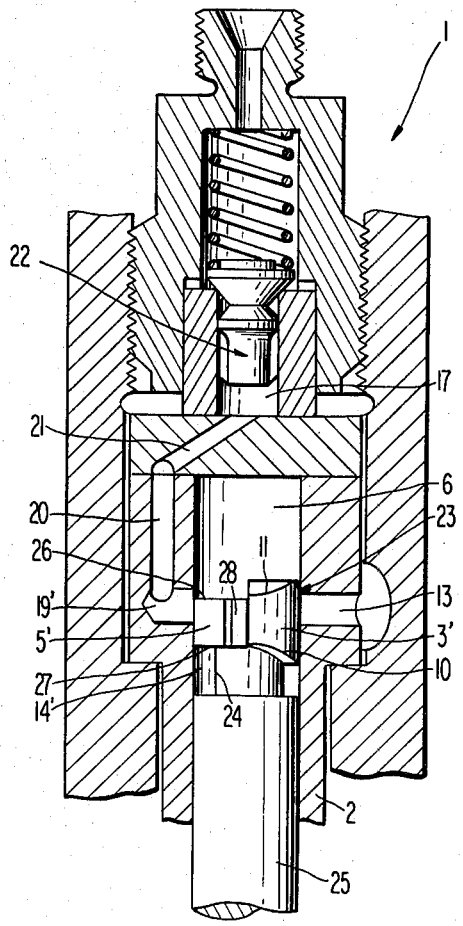
FIG. 2 is a longitudinal cross-sectional view of a pump element having a pump piston and integral fuel control elements in accordance with another embodiment of the present invention.
Figure 3:
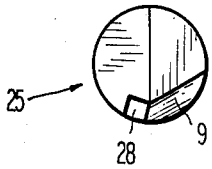
FIG. 3 is a top view of the pump piston of FIG. 2.

The embodiment of FIGS. 2 and 3 differs from the embodiment of FIG. 1 in that the control of the cross section is not housed in a separate control element but rather within the pump piston 3. In this case, the pump piston 3 is composed of a pump head 23 with an integrated control element 5' which occupies or forms one-half of the pump head 23. The pump head 23 is arranged on a neck 24 and a piston shank 25.

The control edges 10 cooperating with the control bore 13 are at least approximately of the same construction as those of the pump piston 3 of the embodiment of FIG. 1.

The crown or bottom 3 of the pump piston 3 is stepped with a lower step 26 which simultaneously constitutes one-half of the pump head 23 wherein the control element 5' is accommodated. The step 26 is provided as the upper control edge 11 for the preliminary injection; whereas, a lower control edge 27 is provided for controlling the principal injection. A continuous groove 28 arranged in the control element 5', connects the annular pump working chamber 14' formed by the neck 24 and the pump cylinder 2, constantly with the intermediate chamber or reservoir 6.

The mode of operation of the embodiment of FIGS. 2 and 3 is as follows:

In the bottom dead center position of the pump piston 3', all of the chambers, i.e., pump working chamber 14', intermediate chamber 6, and pump pressure chamber 17 of the pump element 1 of the fuel injection pump are filled. During an upward stroke of the pump piston 3', the top-positioned control edge 11 closes the control bore 13. At this point in time, the preliminary injection starts and lasts until the upper control edge 26 closes the inlet or feed bore 19'. The communication between the pump working chamber 14' and intermediate chamber 6 and the pump pressure chamber 17 is temporarily interrupted. The pressure in the pump working chamber 14' and intermediate chamber 6 rises until the lower control edge 27 has reached the inlet or feed bore 19'. The principal injection begins at this point, which injection ends only when the bottom-positioned control edge 10 has moved beyond the control bore 13.

While I have shown and described only two embodiments in accordance with the present invention, it is understood that the same is not limited thereto, but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A fuel injection pump for an air-compressing fuel injected internal combustion engine, the fuel injection pump including a pump piston means arranged in a pump cylinder means for controlling a fuel control bore communicating with a pump working chamber means, a fuel control element in constant connection with the pump piston means, means provided in said control element for constantly communicating the pump working chamber means with an intermediate chamber means disposed above the control element and for communicating the pump working chamber means with a pump pressure chamber means during a stroke of the piston means, characterized in that means are provided for temporarily interrupting the communication between the pump working chamber means and the pump pressure chamber means for a predetermined period of time during a stroke of the pump piston means such that, prior to the interruption, a variable preliminary injection quantity of fuel is conveyed and subsequent to the interruption, a principal injection quantity of fuel is conveyed by the fuel injection pump, the control element is integrated into the pump piston, the pump piston means includes a top control edge means and a bottom control edge means for controlling the flow of fuel to be injected, the top control edge means and bottom control edge means being arranged on a first half of the pump piston means, the means for constantly communicating the pump working chamber means with the intermediate chamber means and for communicating the pump working chamber means with the pump pressure chamber means includes a bore arrangement leading to the pump pressure chamber means, the control element includes a top and bottom control edge means arranged in a half of the pump piston means disposed oppositely the half of the pump piston means provided with the top and bottom control edge means, the pump piston means includes a neck portion disposed beneath the control element, the neck portion and a portion of the pump cylinder means form an annular chamber means defining the pump working chamber means, and in that a passage means is provided in the control element for placing the annular chamber means in constant communication with the intermediate chamber means, and the top control edge means of the control element serves to interrupt a feed of fuel so as to define an end of the preliminary injection and the bottom control edge means of the control element serves to reinstate the feed of the fuel so as to define a beginning of the principal injection.

2. A fuel injection pump for an air-compressing fuel injected internal combustion engine, the fuel injection pump including a pump piston means arranged in a pump cylinder means for controlling a fuel control bore communicating with a pump working chamber means, a fuel control element in constant connection with the pump means, means provided in said control element for constantly communicating the pump working chamber means with an intermediate chamber means disposed above the control element and for communicating the pump working chamber means with a pump pressure chamber means during a stroke of the piston means, characterized in that means are provided for temporarily interrupting the communication between the pump working chamber means and the pump pressure chamber means for a predetermined period of time during a stroke of the pump piston means such that, prior to the interruption a variable preliminary injection quantity of fuel is conveyed and subsequent to the interruption, a principal injection quantity of fuel is conveyed by the fuel injection pump, wherein said means for constantly communicating comprises means for communicating the pump working chamber with the pump pressure chamber indirectly via said intermediate chamber means prior to interruption and means for communicating the pump working chamber with the pump pressure chamber directly subsequent to the interruption.

3. A fuel injection pump for an air-compressing fuel injected internal combustion engine, the fuel injection pump including a pump piston means arranged in a pump cylinder means for controlling a fuel control bore communicating with a pump working chamber means, a fuel control element in constant connection with the pump piston means, means provided in said control element for constantly communicating the pump working chamber means with an intermediate chamber means disposed above the control element and for communicating the pump working chamber means with a pump pressure chamber means exclusively by one of directly and indirectly via said intermediate chamber means during a stroke of the piston means, characterized in that means are provided for temporarily interrupting the said communication between the pump working chamber means and the pump pressure chamber means for a predetermined period of time during a stroke of the pump piston means such that, prior to the interruption, a variable preliminary injection quantity of fuel is conveyed by said indirect communication, and subsequent to the interruption, a principal injection quantity of fuel is conveyed by said direct communication by the fuel injection pump.

4. A fuel injection pump for an air-compressing fuel injected internal combustion engine, the fuel injection pump including a pump piston means arranged in a pump cylinder means for controlling a fuel control bore communicating with a pump working chamber means, a fuel control element arranged in the pump cylinder means, means provided in said control element for constantly communicating the pump working chamber means with an intermediate chamber means disposed above the control element and for communicating the pump working chamber means with a pump pressure chamber means exclusively either directly or indirectly via said intermediate chamber means, during a stroke of the piston means, characterized in that means are provided for temporarily interrupting the said communication between the pump working chamber means and the pump pressure chamber means for a predetermined period of time during a stroke of the pump piston means such that, prior to the interruption, a variable preliminary injection quantity of fuel is conveyed by said indirect communication, and subsequent to the interruption, a principal injection quantity of fuel is conveyed by said direct communication by the fuel injection pump.

5. A fuel injection pump according to claim 2, characterized in that the interrupting means includes a control edge means arranged at a top portion of the pump piston means for controlling the preliminary injection quantity.

6. A fuel injection pump according to claim 4, characterized in that the control element is formed by a control slide means longitudinally displaceably guided in a control cylinder, the means for constantly communicating the pump working chamber means with the intermediate chamber means and for communicating the pump working chamber means with the pump pressure chamber means includes a bore arrangement provided in the control slide means, the bore arrangement includes a first bore for communicating the pump working chamber means and the intermediate chamber means and two additional bores branching off from the first bore, a first of the two additional bores serving as a preliminary injection bore and a second of the two additional bores serving as a principal injection valve.

7. A fuel injection pump according to claim 6, characterized in that the means for constantly communicating the pump working means with the intermediate chamber means and for communicating the pump working chamber means with the pump pressure chamber means further includes a second bore arrangement provided in the control cylinder and communicating with the pressure chamber means and the bore arrangement provided in the control slide means, the pump pressure chamber means being first brought into communication with the pump working chamber means by the first bore of the two additional bores of the control slide means and subsequently once again brought into communication by the second of the two additional bores.

8. A fuel injection pump according to claim 2, characterized in that the control element is integrated into the pump piston.

9. A fuel injection pump according to claim 2, characterized in that the pump piston means includes a top control edge means and a bottom control edge means for controlling the flow of fuel to be injected, the top control edge means and bottom control edge means being arranged on a first half of the pump piston means, the means for constantly communicating the pump working chamber means with the intermediate chamber means and for communicating the pump working chamber means with the pump pressure chamber means includes a bore arrangement leading to the pump pressure chamber means, the control element includes a top and bottom control edge means arranged in a half of the pump piston means disposed oppositely the half of the pump piston means provided with the top and bottom control edge means, the piston means includes a neck portion disposed beneath the control element, the neck portion and a portion of the pump cylinder means form an annular chamber means defining the pump working chamber means, and in that a passage means is provided in the control element for placing the annular chamber means in constant communication with the intermediate chamber means.

* * * * *